US012736247B2

(12) United States Patent
Xia et al.

(10) Patent No.: US 12,736,247 B2
(45) Date of Patent: Sep. 15, 2026

(54) CONTROL METHOD AND DEVICE SUITABLE FOR AIR CONDITIONER IN HIGH DROP MODE

(71) Applicant: Guangdong Carrier HVAC Co., Ltd, Foshan Guangdong (CN)

(72) Inventors: Qiren Xia, Foshan Guangdong (CN); Zhongyuan Ye, Foshan Guangdong (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 184 days.

(21) Appl. No.: 18/673,307

(22) Filed: May 24, 2024

(65) Prior Publication Data

US 2024/0401859 A1 Dec. 5, 2024

(51) Int. Cl.

| | |
|---|---|
| ***F24F 11/64*** | (2018.01) |
| ***F24F 11/86*** | (2018.01) |
| ***F24F 140/12*** | (2018.01) |
| ***F24F 140/20*** | (2018.01) |
| ***F25B 49/02*** | (2006.01) |

(52) U.S. Cl.

CPC ..... *F24F 11/64* (2018.01); *F24F 11/86* (2018.01); *F25B 49/022* (2013.01); *F24F 2140/12* (2018.01); *F24F 2140/20* (2018.01); *F25B 2400/01* (2013.01); *F25B 2500/16* (2013.01);

(Continued)

(58) Field of Classification Search

CPC ..... F24F 11/64; F24F 11/84; F24F 2140/12; F24F 2140/20; F24F 2110/12; F24F 11/43; F24F 11/65; F24F 11/61; F24F 11/70; F25B 49/022; F25B 2400/01;

(Continued)

(56) References Cited

U.S. PATENT DOCUMENTS

2015/0330651 A1* 11/2015 Goel ..... F25B 49/005 62/228.1

FOREIGN PATENT DOCUMENTS

AU 2012200688 A1 * 9/2012 ..... F25B 49/00
CN 201407162 Y * 2/2010

(Continued)

OTHER PUBLICATIONS

Extended European Search Report received for EP Application No. 24178506.2, mailed on Feb. 10, 2024, 9 Pages,.

*Primary Examiner* — Kun Kai Ma
(74) *Attorney, Agent, or Firm* — Souad Hakim

(57) ABSTRACT

Embodiments of the present disclosure provide a control method suitable for an air conditioner in a high-drop mode, wherein the air conditioner comprises at least a compressor, and a crankshaft heating belt is provided at the bottom of the compressor. The control method comprises: detecting an outdoor ambient temperature and a compressor exhaust temperature in real time; determining whether the air conditioner meets a preheating condition; if the air conditioner meets the preheating condition, turning on the crankshaft heating belt; and determining whether the air conditioner is in a high-drop mode; if the air conditioner is in the high-drop mode, determining whether the air conditioner is in a cooling mode; if the air conditioner is in the cooling mode, turning on the compressor, and determining whether to turn off the crankshaft heating belt based on an operating duration of the compressor and the compressor exhaust temperature.

16 Claims, 3 Drawing Sheets

(52) U.S. Cl.
CPC ... *F25B 2500/26* (2013.01); *F25B 2700/2106* (2013.01); *F25B 2700/21152* (2013.01)

(58) Field of Classification Search
CPC ..... F25B 2500/16; F25B 2500/26; F25B 2700/2106; F25B 2700/21152; Y02B 30/70
See application file for complete search history.

(56) References Cited

FOREIGN PATENT DOCUMENTS

| | | | | | |
|---|---|---|---|---|---|
| CN | 202149569 | U | * | 2/2012 | |
| CN | 102635926 | A | | 8/2012 | |
| CN | 105091200 | A | | 11/2015 | |
| CN | 107388361 | A | | 11/2017 | |
| CN | 108266900 | A | * | 7/2018 | ..... F24H 9/2021 |
| CN | 108286802 | A | * | 7/2018 | ..... F25B 49/022 |
| CN | 111765606 | A | | 10/2020 | |
| CN | 109210696 | B | | 11/2020 | |
| CN | 214949386 | U | | 11/2021 | |
| CN | 112963934 | B | | 10/2022 | |
| CN | 115307270 | A | * | 11/2022 | ..... F24F 11/89 |
| CN | 113639406 | B | | 12/2022 | |
| CN | 115540362 | A | * | 12/2022 | ..... F24H 15/395 |
| JP | 2008170052 | A | * | 7/2008 | |
| JP | 6387197 | B1 | | 9/2018 | |
| WO | WO-2010103734 | A1 | * | 9/2010 | ..... F25B 49/005 |

* cited by examiner

CONTROL METHOD AND DEVICE SUITABLE FOR AIR CONDITIONER IN HIGH DROP MODE

CROSS REFERENCE TO RELATED APPLICATION

This application claims the benefit of CN patent Application CN202310621825.4 filed on May 23, 2023, which is incorporated by reference herein in its entirety.

TECHNICAL FIELD

The present invention relates to the field of air conditioners, and specifically to a control method and device suitable for an air conditioner in a high-drop mode.

BACKGROUND

There is usually a certain drop and pipe length between an indoor heat exchanger and an outdoor heat exchanger of an air conditioning system during installation. The units instruction manual generally specifies the installation restrictions for a high drop or long pipe, for example, around 20 m (a high drop) and 40 m (a long pipe). If installation is not carried out in accordance with the requirements in the units instruction manual during actual installation, it will cause an unconventional high-drop or long-pipe installation.

When a vertical height or pipe length between the indoor heat exchanger and the outdoor heat exchanger is too large, under a low-temperature heating condition, a cavity of a compressor is filled with a mixture of a lubricating oil and a refrigerant. If the compressor is started directly, the refrigerant in the cavity will evaporate quickly, taking the lubricating oil away from the compressor. In the case of the high drop and long pipe, the lubricating oil cannot return to the compressor in a short time, and the lower the outdoor operating temperature, the longer the oil return time. When there is an insufficient lubricating oil in the compressor, losses of internal winding coils and a motor of the compressor will increase.

For a fixed frequency machine, there is a lack of oil return means, and it is impossible to alleviate the problem of lubricating oil being carried away from the compressor during the starting process by means of low-frequency transition. It is difficult for a fixed-frequency top-outlet machine to operate normally in the same way as in a normal mode under high-drop conditions, and problems such as difficulty in oil return and low-pressure protection may occur.

For most machines, if a temperature controller is not installed, an outdoor unit only provides a defrosting signal feedback to an indoor unit based on existing procedures. If the outdoor unit is in a crankshaft heating belt preheating state, when there is no temperature controller control and the outdoor unit is not started, there will be no signal feedback to an indoor room, resulting in electrical heating being unable to operate normally and no heating indoors, affecting user experience.

SUMMARY

In view of the above problems, the present invention provides a control method and device suitable for an air conditioner in a high-drop mode. By setting turning-off conditions of a crankshaft heating belt in different modes, a compressor can be fully preheated, to solve a problem of difficulty in oil return in the high-drop mode.

The present invention provides a control method suitable for an air conditioner in a high-drop mode. The air conditioner includes at least a compressor, and a crankshaft heating belt is provided at the bottom of the compressor. The control method includes: detecting an outdoor ambient temperature and a compressor exhaust temperature in real time; determining whether the air conditioner meets a preheating condition; and if the air conditioner does not meet the preheating condition, not turning on the crankshaft heating belt.

In one or more embodiments, if the air conditioner meets the preheating condition, turning on the crankshaft heating belt; and determining whether the air conditioner is in a high-drop mode, and if the air conditioner is in the high-drop mode, determining whether the air conditioner is in a cooling mode; and performing the following operations based on whether the air conditioner is in the cooling mode: if the air conditioner is in the cooling mode, turning on the compressor, and determining whether to turn off the crankshaft heating belt based on an operating duration of the compressor and the compressor exhaust temperature.

In one or more embodiments, if the air conditioner is in a non-cooling mode and is powered on for the first time, prohibiting starting the compressor, and determining whether to turn off the crankshaft heating belt based on a turning-on duration of the crankshaft heating belt, the outdoor ambient temperature, and the compressor exhaust temperature.

In one or more embodiments, if the air conditioner is in a non-cooling mode and is not powered on for the first time, determining whether to turn off the crankshaft heating belt based on the outdoor ambient temperature and the compressor exhaust temperature.

In one or more embodiments, during turning on of the crankshaft heating belt, determining whether the air conditioner meets a compressor turning-on condition, where the compressor turning-on condition includes: in the high-drop mode, the air conditioner is in the cooling mode; or in the high-drop mode, the air conditioner is in the non-cooling mode, and the outdoor ambient temperature is higher than a first preset ambient temperature.

According to the technical solution, in one or more embodiments, in the high-drop mode, during turning on of the crankshaft heating belt, the air conditioner is in the cooling mode, the compressor is turned on directly, and whether to turn off the crankshaft heating belt is determined based on the operating duration of the compressor and the compressor exhaust temperature. When the air conditioner is in the non-cooling mode, if the air conditioner is powered on for the first time, the compressor is prohibited from being started, and whether to turn off the crankshaft heating belt is determined based on the turning-on duration of the crankshaft heating belt, the outdoor ambient temperature, and the compressor exhaust temperature (where the compressor is turned on). If the air conditioner is not powered on for the first time, whether to turn off the crankshaft heating belt is determined directly based on the outdoor ambient temperature and the compressor exhaust temperature (where the compressor is turned on). By setting respective different crankshaft heating belt turning-off conditions in different modes, the performance of preheating the compressor in the different modes can be improved, so that a refrigerant can fully evaporate during preheating and a lubricating oil remains in a cavity of the compressor, to overcome a problem of difficulty in oil return in the high-drop mode in the prior art. In the non-cooling mode, whether the air conditioner is powered on for the first time is determined, which can avoid the compressor to be started directly when the air conditioner is powered on for the first time and the outdoor ambient temperature is too low, resulting in abnormal oil return and damage to the compressor. Therefore, it is necessary to limit this situation of first powering-on. If the air conditioner is not powered on for the first time, the crankshaft heating belt will preheat the compressor based on ambient temperature, so there is no need to limit the compressor. When the compressor needs to be started, the machine itself is in an appropriate state and there is no impact on the compressor. (For North America, air conditioners are generally powered continuously, so the impact of limiting the starting of the compressor for first powering-on can be ignored. The control method is applicable to a case in which the compressor needs to be preheated when the air conditioner is powered on for the first time). During preheating, turning on the compressor at the right time can protect the compressor on the one hand, and can ensure user needs and improve user experience on the other hand.

In one or more embodiments, the determining whether to turn off the crankshaft heating belt based on an operating duration of the compressor and the compressor exhaust temperature includes: when the operating duration of the compressor reaches a first preset duration and the compressor exhaust temperature is not less than a first preset exhaust temperature, controlling to turn off the crankshaft heating belt.

In one or more embodiments, the determining whether to turn off the crankshaft heating belt based on a turning-on duration of the crankshaft heating belt, the outdoor ambient temperature, and the compressor exhaust temperature includes: when the turning-on duration of the crankshaft heating belt is not less than a second preset duration, the outdoor ambient temperature is greater than the first preset ambient temperature, and the compressor exhaust temperature is not less than the first preset exhaust temperature, controlling to turn off the crankshaft heating belt.

In one or more embodiments, in the cooling mode or the non-cooling mode, the crankshaft heating belt is turned off in time, which is beneficial for reducing electricity consumption.

In one or more embodiments, the preheating condition includes: the air conditioner is powered on for the first time, and until a startup signal is received, the compressor exhaust temperature is less than a second preset exhaust temperature for a third preset duration.

In one or more embodiments, the compressor is powered on for the first time, and when the startup signal is received, the compressor exhaust temperature is less than the second preset exhaust temperature for the third preset duration, indicating that the air conditioner may be in a low temperature environment for a long time, and the cavity of the compressor is filled with a mixture of the lubricating oil and the refrigerant, and turning on the crankshaft heating belt at this time can preheat the compressor to increase the temperature of the lubricating oil in the compressor and prevent the refrigerant in the cavity of the compressor from evaporating to take away the lubricating oil when the compressor is started subsequently, thereby ensuring stable and reliable operation of the compressor.

In one or more embodiments, the preheating condition includes: the air conditioner is in a defrosting mode, and the compressor exhaust temperature is less than a third preset exhaust temperature.

In one or more embodiments, when the outdoor ambient temperature is low and the compressor exhaust temperature is also low, and when the compressor exhaust temperature is less than the third preset exhaust temperature and the air conditioner is in the defrosting mode, the crankshaft heating belt is turned on, which can increase the temperatures of the refrigerant and the lubricating oil in the compressor, ensuring that the refrigerant fully evaporates when the compressor is started, and the lubricating oil can have a better lubrication effect in the cavity of the compressor.

In one or more embodiments, the preheating condition includes: the compressor exhaust temperature is less than a fourth preset exhaust temperature or an exhaust temperature sensor is in a bad state; and the outdoor ambient temperature is lower than a second preset ambient temperature, and a shutdown duration of the compressor is greater than a fourth preset duration.

In one or more embodiments, when the compressor exhaust temperature is low, the outdoor ambient temperature is low, and the shutdown duration of the compressor is long, the crankshaft heating belt is turned on to heat the lubricating oil and the refrigerant in the cavity of the compressor, so that when the compressor is started, the refrigerant fully evaporates, the lubricating oil has good lubrication performance and is unlikely to enter a refrigerant circulation pipeline with the refrigerant, thereby solving the problem of difficulty in oil return in the high-drop mode.

In one or more embodiments, the air conditioning system further includes an indoor heat exchanger and an outdoor electrical control panel, an electrical heating device is provided at an outlet of the indoor heat exchanger, an electrical heating signal line is connected between the indoor heat exchanger and the outdoor electrical control panel, the outdoor electrical control panel controls the electrical heating device to turn on or off through the electrical heating signal line, and the control method further includes: during turning on of the crankshaft heating belt and when electrical heating is turned off, determining whether the air conditioner meets an electrical heating turning-on condition, and if the electrical heating turning-on condition is met, controlling to turn on electrical heating; and the electrical heating turning-on condition includes: the air conditioner is in the high-drop mode, the air conditioner is operating in a heating mode, and is powered on for the first time, and the crankshaft heating belt is in a turned-on state; or the air conditioner is in a defrosting mode.

In one or more embodiments, during preheating of the compressor, whether the electrical heating turning-on condition is met is determined to turn on electrical heating, so that normal indoor heating can be met, and the user experience can be improved. When the compressor is in a turned-off state, a communication signal from an outdoor unit to an indoor unit can be realized to ensure turning on of indoor electrical heating, which ensures the heating effect in a low temperature environment, and overcomes problems that: the heating effect of the compressor is not obvious and the compressor is easily damaged under low temperature conditions, and problems that: when the compressor is not started, there is no signal from the outdoor unit to the indoor unit based on an original program, electrical heating cannot be turned on, and there is no heating indoors.

In one or more embodiments, after electrical heating is turned on, it is determined whether the air conditioner meets an electrical heating turning-off condition, and the electrical heating turning-off condition includes: the air conditioner does not meet any of the electrical heating turning-on conditions.

In one or more embodiments, when the air conditioner does not meet the electrical heating turning-on condition, electrical heating is turned off, which is beneficial for avoiding unnecessary energy consumption and saving energy.

In one or more embodiments, the electrical heating turning-on condition further includes: the air conditioner is in the high-drop mode and in the heating mode, it is detected that the compressor is in a started state, and when the outdoor ambient temperature is lower than a third preset ambient temperature, the compressor is turned off, and electrical heating is turned on.

In one or more embodiments, in the high-drop mode and the heating mode, when the compressor is detected to be turned on, if the outdoor ambient temperature is less than the third preset ambient temperature, electrical heating is turned on, and the compressor is turned off, which can prevent the lubricating oil from entering the pipeline with the refrigerant in the low temperature environment, thereby solving the problem of difficulty in oil return. At the same time, in the low temperature environment, if the refrigerant is mixed into the lubricating oil, turning on electrical heating and turning off the compressor can avoid liquid hammer on the compressor, increasing the service life of the compressor while meeting the heating demand.

In one or more embodiments, the control method further includes, after electrical heating is turned on, when the outdoor ambient temperature is greater than the first preset ambient temperature, performing the following operations based on whether the crankshaft heating belt is turned on: if the crankshaft heating belt is turned on, the outdoor unit is in the high-drop mode, and is powered on for the first time, the turning-on duration of the crankshaft heating belt is not less than the second preset duration, and the outdoor ambient temperature is continuously greater than the first preset ambient temperature, controlling to start the compressor and turn off electrical heating; or if the crankshaft heating belt is not turned on, and the outdoor ambient temperature is continuously greater than the first preset ambient temperature, controlling to start the compressor and turn off electrical heating.

In one or more embodiments, when the outdoor ambient temperature is greater than the first preset ambient temperature, and the turning-on duration of the crankshaft heating belt reaches the second preset duration, electrical heating is turned off, which can meet the heating demand and avoid unnecessary power consumption, which is beneficial to saving energy.

The present invention further provides a control device suitable for an air conditioner in a high-drop mode, which performs the control method suitable for an air conditioner in a high-drop mode as described above.

REFERENCE NUMERALS

Figure 1:
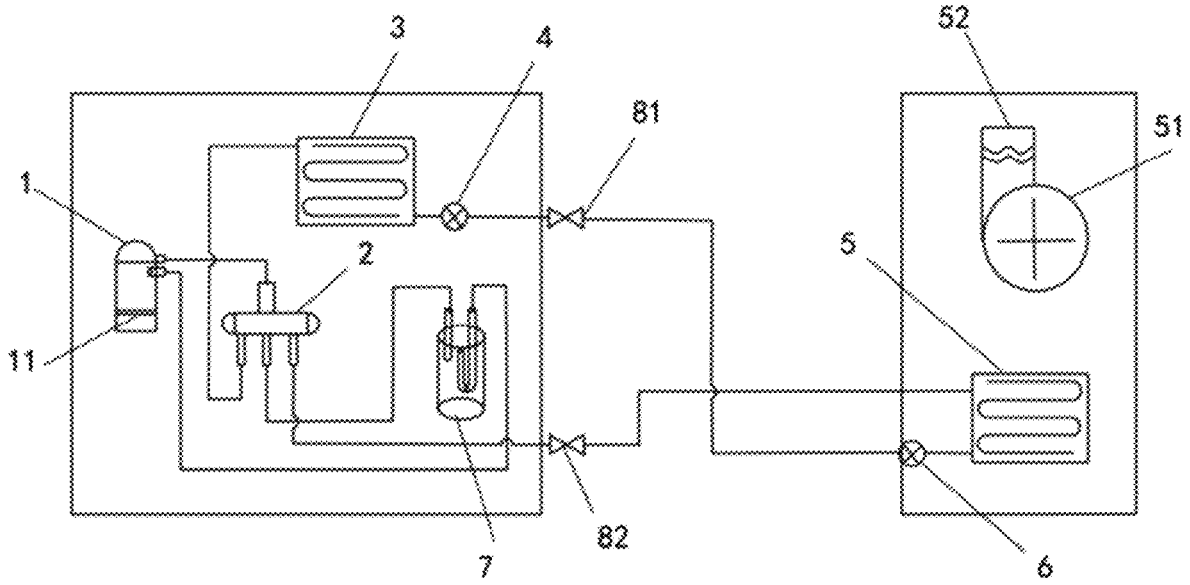
FIG. 1 is a schematic diagram of a structure of an air conditioning system according to an embodiment of the present invention.

Compressor 1; crankshaft heating belt 11; four-way valve 2; outdoor heat exchanger 3; first throttle valve 4; indoor heat exchanger 5; indoor fan 51; electrical heating device 52; second throttle valve 6; gas-liquid separator 7; first stop valve 81; and second stop valve 82.

DETAILED DESCRIPTION

The technical solutions in embodiments of the present invention are described clearly and completely below with reference to the accompanying drawings in embodiments of the present invention. Apparently, the described embodiments are merely a part rather than all of the embodiments of the present invention. All other embodiments obtained by those of ordinary skill in the art based on the embodiments of the present invention without any creative efforts shall fall within the protection scope of the present invention.

As shown in FIG. 1, an embodiment of the present invention provides an air conditioning system, including a compressor 1, a four-way valve 2, an outdoor heat exchanger 3, a first throttle valve 4, an indoor heat exchanger 5, a second throttle valve 6, and a gas-liquid separator 7 which are sequentially connected to form a refrigerant circulation flow path, where the compressor 1, the four-way valve 2, the outdoor heat exchanger 3, the first throttle valve 4, and the gas-liquid separator 7 constitute an outdoor unit of the air conditioning system, a crankshaft heating belt 11 is provided at the bottom of the compressor 1, a first stop valve 81 is provided between the first throttle valve 4 and the indoor heat exchanger 5, a second stop valve 82 is provided between the indoor heat exchanger 5 and the four-way valve 2, an indoor fan 51 is provided at an outlet of the indoor heat exchanger 5, an electrical heating device 52 is provided next to the indoor fan 51, and the indoor heat exchanger 5, the indoor fan 51, the electrical heating device 52, and the second throttle valve 6 constitute components of an indoor unit. The air conditioning system further includes an outdoor electrical control panel (not shown in the figure), and an electrical heating signal line (not shown in the figure) is connected between the electrical heating device 52 and the outdoor electrical control panel. The outdoor electrical control panel controls the electrical heating device 52 to be turned on or off through the electrical heating signal line. Furthermore, the air conditioning system further includes an ambient temperature sensor for detecting an outdoor ambient temperature, an exhaust temperature sensor for detecting a compressor exhaust temperature, and a timing module. The timing module measures time data such as an operating duration of the compressor 1, a shutdown duration of the compressor 1, an operating duration of the crankshaft heating belt 11, and a duration of the compressor exhaust temperature T5 in a specified condition. It should be noted that, although the present embodiment shows a structure of the above-mentioned air conditioning system, it should not constitute a limitation on the air conditioning system.

Figure 2:
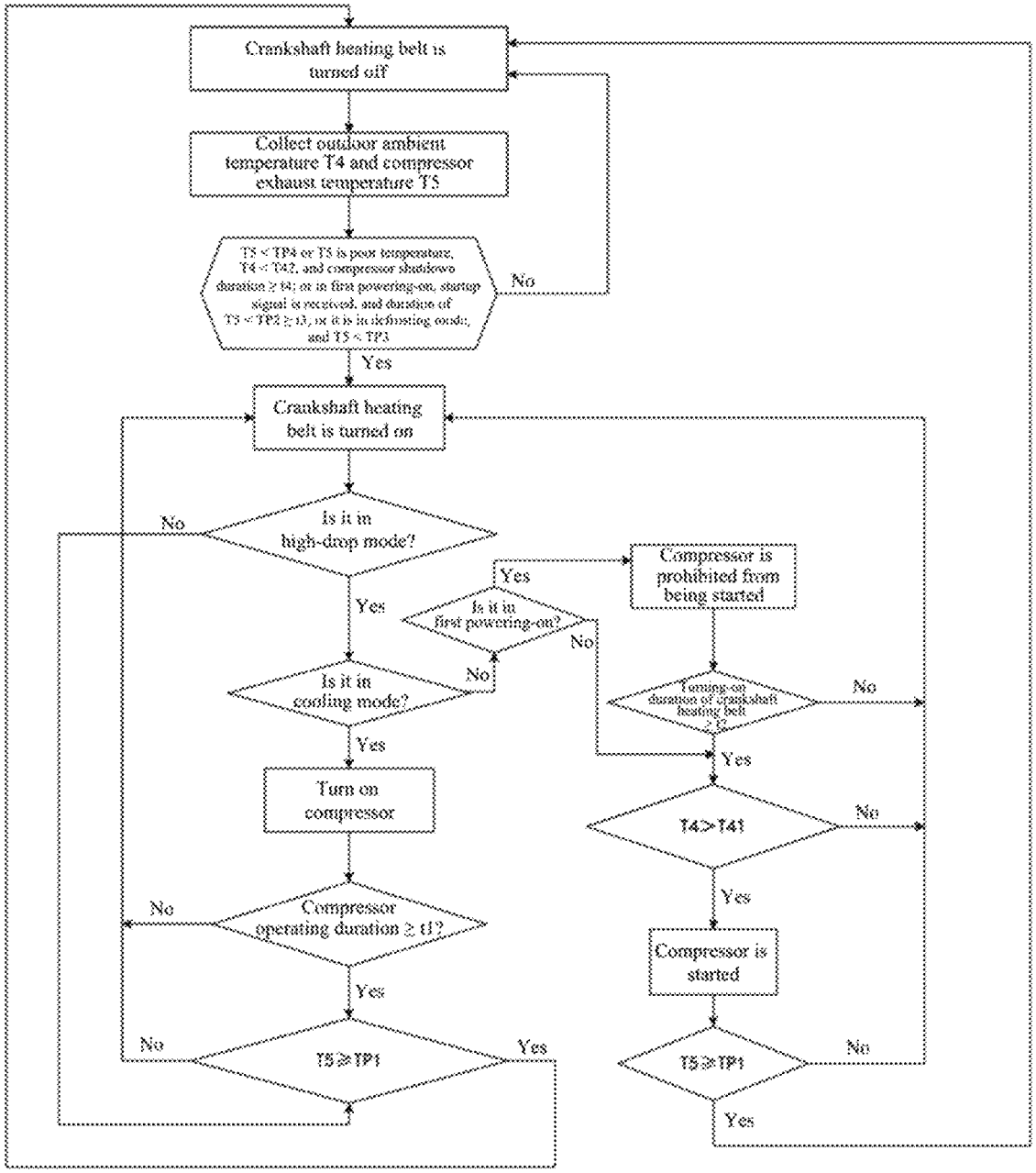
FIG. 2 is a schematic flowchart of a control method suitable for an air conditioner in a high-drop mode according to an embodiment of the present invention.

For the above-mentioned air conditioning system, as shown in FIG. 2, an embodiment of the present invention provides a control method suitable for an air conditioner in a high-drop mode, including the following steps: detecting the outdoor ambient temperature T4 and the compressor exhaust temperature T5 in real time; determining whether the air conditioner meets a preheating condition; and if the air conditioner does not meet the preheating condition, not turning on the crankshaft heating belt 11; if the air conditioner meets the preheating condition, turning on the crankshaft heating belt 11; and determining whether the air conditioner is in a high-drop mode, and if the air conditioner is not in the high-drop mode, determining whether to turn off the crankshaft heating belt based on a comparison result of the compressor exhaust temperature T5 and a first preset exhaust temperature TP1; or if the air conditioner is in the high-drop mode, determining whether the air conditioner is in a cooling mode; and performing the following operations based on whether the air conditioner is in the cooling mode: if the air conditioner is in the cooling mode, turning on the compressor 1 (excluding a case in which the cooling mode is limited from being started when the temperature is lower than 14° C., and a lower limit temperature for turning on the cooling mode is different for different machines), and determining whether to turn off the crankshaft heating belt 11 based on an operating duration of the compressor 1 and the compressor exhaust temperature T5.

If the air conditioner is in a non-cooling mode and is powered on for the first time, prohibiting starting the compressor 1, and determining whether to turn off the crankshaft heating belt 11 based on a turning-on duration of the crankshaft heating belt 11, the outdoor ambient temperature T4, and the compressor exhaust temperature T5; or if the air conditioner is in a non-cooling mode and is not powered on for the first time, determining whether to turn off the crankshaft heating belt 11 based on the outdoor ambient temperature T4 and the compressor exhaust temperature T5; and where if any one of the turning-on duration of the crankshaft heating belt 11, the outdoor ambient temperature T4, and the compressor exhaust temperature T5 does not meet the above-mentioned preset condition, the crankshaft heating belt continues to be turned on.

During turning on of the crankshaft heating belt 11, determining whether the air conditioner meets a compressor turning-on condition, where the compressor turning-on condition includes: in the high-drop mode, the air conditioner is in the cooling mode; or in the high-drop mode, the air conditioner is in the non-cooling mode, and the outdoor ambient temperature T4 is higher than a first preset ambient temperature T41.

In the above-mentioned manner, in the high-drop mode, during turning on of the crankshaft heating belt 11, the air conditioner is in the cooling mode, the compressor 1 is turned on directly, and whether to turn off the crankshaft heating belt 11 is determined based on the operating duration of the compressor 1 and the compressor exhaust temperature T5. When the air conditioner is in the non-cooling mode, if the air conditioner is powered on for the first time, the compressor 1 is prohibited from being started, and whether to turn off the crankshaft heating belt 11 is determined based on the turning-on duration of the crankshaft heating belt 11, the outdoor ambient temperature T4, and the compressor exhaust temperature T5 (where the compressor 1 is turned on). If the air conditioner is not powered on for the first time, whether to turn off the crankshaft heating belt 11 is determined directly based on the outdoor ambient temperature T4 and the compressor exhaust temperature T5 (where the compressor 1 is turned on). By setting respective different crankshaft heating belt turning-off conditions in different modes, the performance of preheating the compressor 1 in the different modes can be improved, so that a refrigerant can fully evaporate when the compressor 1 is started and a lubricating oil remains in a cavity of the compressor, to overcome a problem of difficulty in oil return in the high-drop mode in the prior art. In the cooling mode, the compressor 1 is directly turned on, so that during preheating, a user need are met when the user has the cooling need. In the non-cooling mode, whether the air conditioner is powered on for the first time is determined, which can avoid the compressor 1 to be started directly when the air conditioner is powered on for the first time and the outdoor ambient temperature is too low, resulting in abnormal oil return and damage to the compressor 1. Therefore, it is necessary to limit this situation of first powering-on. If the air conditioner is not powered on for the first time, the crankshaft heating belt 11 will preheat the compressor 1 based on the outdoor ambient temperature, so there is no need to limit the compressor 1. When the compressor 1 needs to be started, the machine itself is in an appropriate state and there is no impact on the compressor 1. (For North America, air conditioners are generally powered continuously, so the impact of limiting the starting of the compressor 1 for first powering-on can be ignored. This control method is applicable to a case in which the compressor needs to be preheated when the air conditioner is powered on for the first time). The temperature difference gradient can also be used to avoid frequent turning-off of the compressor 1 in the non-cooling mode, ensuring reliable operating of the air conditioner. During preheating, turning on the compressor 1 at a right time can meet the user need and improve user experience.

In a preferred embodiment of the present invention, the determining whether to turn off the crankshaft heating belt 11 based on an operating duration of the compressor 1 and the compressor exhaust temperature T5 includes: when the operating duration of the compressor 1 reaches a first preset duration t1 and the compressor exhaust temperature T5 is not less than the first preset exhaust temperature TP1, controlling to turn off the crankshaft heating belt 11.

The determining whether to turn off the crankshaft heating belt 11 based on a turning-on duration of the crankshaft heating belt 11, the outdoor ambient temperature T4, and the compressor exhaust temperature T5 includes: when the turning-on duration of the crankshaft heating belt 11 is not less than a second preset duration t2, the outdoor ambient temperature T4 is greater than the first preset ambient temperature T41, and the compressor exhaust temperature T5 is not less than the first preset exhaust temperature TP1, controlling to turn off the crankshaft heating belt 11.

In the above-mentioned manner, in the cooling mode or the non-cooling mode, the crankshaft heating belt 11 is turned off in time, which is beneficial for reducing electricity consumption.

In a preferred embodiment of the present invention, when the turning-on duration of the crankshaft heating belt 11 is up to 4 h, the outdoor ambient temperature T4>T41, and T5≥TP1, the crankshaft heating belt 11 is controlled to be turned off. Compared with the prior art, in which when the crankshaft heating belt 11 is used to preheat the compressor 1, it usually takes 12 h to heat up, and the compressor 1 is in a turned-off state during preheating, resulting in a gap period, failing to meet the user needs, the present embodiment shortens the preheating time, which is beneficial for extending a service life of the crankshaft heating belt 11, and reducing the energy consumption, and improves the user experience, which is beneficial for meeting the user needs.

In a preferred embodiment of the present invention, the preheating condition includes: (1) the air conditioner is powered on for the first time, and until a startup signal is received, the compressor exhaust temperature T5 is less than a second preset exhaust temperature TP2 for a third preset duration t3; (2) the air conditioner is in a defrosting mode, and the compressor exhaust temperature T5 is less than a third preset exhaust temperature TP3; and (3) the compressor exhaust temperature T5 is less than a fourth preset exhaust temperature TP4 or the exhaust temperature sensor is in a bad state; and the outdoor ambient temperature T4 is lower than a second preset ambient temperature T42, and the shutdown duration of the compressor 1 is greater than a fourth preset duration t4. If any of the above (1) to (3) is met, the crankshaft heating belt 11 can be turned on.

Specifically, for the condition (1), the compressor 1 is powered on for the first time, and when the startup signal is received, the compressor exhaust temperature T5 is less than the second preset exhaust temperature TP2 for the third preset duration t3, indicating that the air conditioner may be in a low temperature environment for a long time, and the cavity of the compressor is filled with a mixture of the lubricating oil and the refrigerant, turning on the crankshaft heating belt 11 at this time can preheat the compressor 1 to increase the temperature of the lubricating oil in the compressor 1 and prevent the refrigerant in the cavity of the compressor from evaporating to take away the lubricating oil when the compressor 1 is started subsequently, thereby ensuring stable and reliable operation of the compressor 1.

For the condition (2), when the outdoor ambient temperature T4 is low and the compressor exhaust temperature T5 is also low, and when the compressor exhaust temperature T5 is less than the third preset exhaust temperature TP3 and the air conditioner is in the defrosting mode, the crankshaft heating belt 11 is turned on, which can increase the temperatures of the refrigerant and the lubricating oil in the compressor 1, ensuring that the refrigerant fully evaporates when the compressor 1 is started, and the lubricating oil can have a better lubrication effect in the cavity of the compressor.

For the condition (3), when the compressor exhaust temperature T5 is low, the outdoor ambient temperature T4 is low, and the shutdown duration of the compressor 1 is long, the crankshaft heating belt 11 is turned on to heat the lubricating oil and the refrigerant in the cavity of the compressor, so that when the compressor 1 is started, the refrigerant fully evaporates, the lubricating oil has good lubrication performance and is unlikely to enter a refrigerant circulation pipeline with the refrigerant, thereby solving the problem of difficulty in oil return in the high-drop mode.

Figure 3:
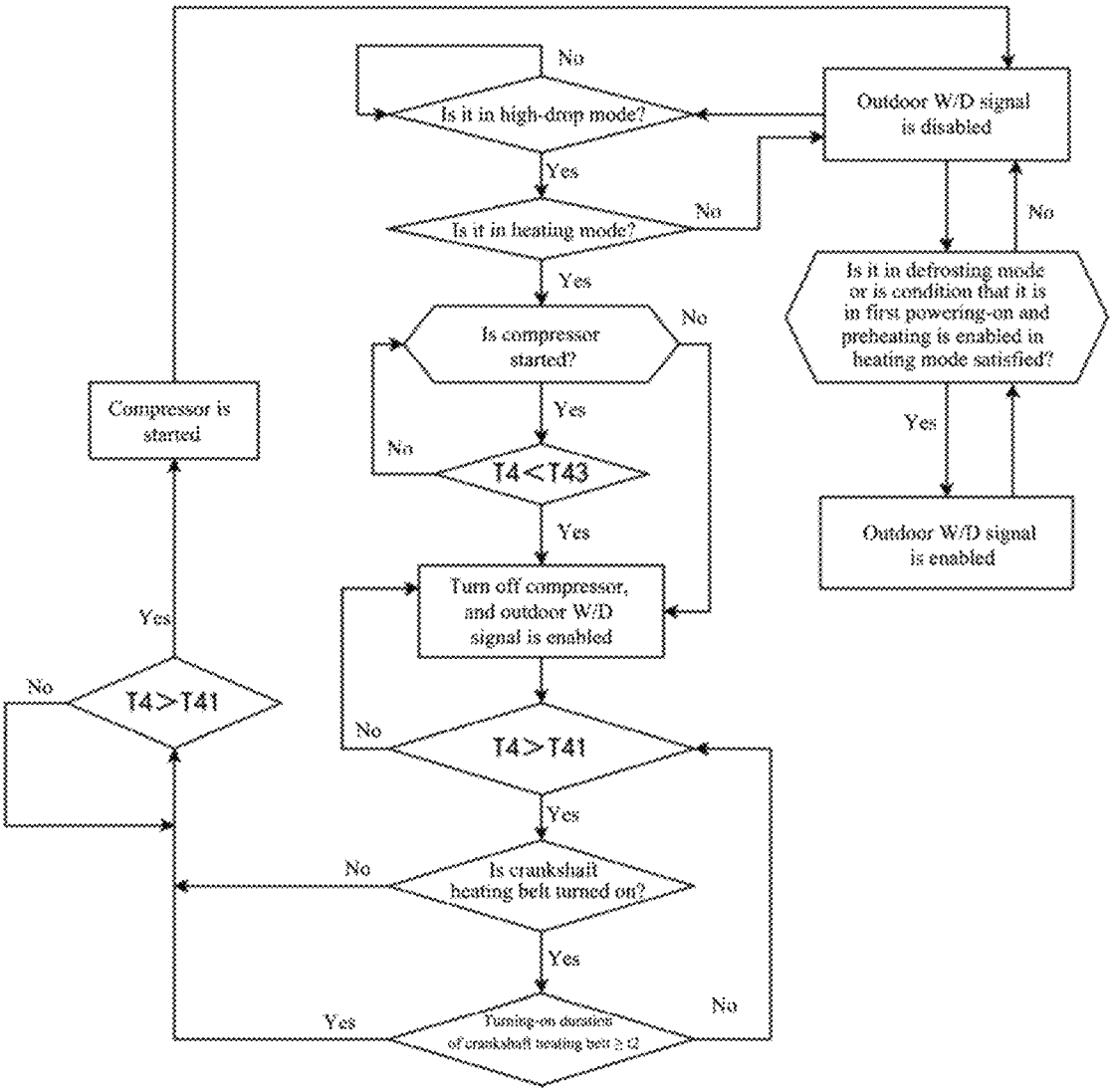
FIG. 3 is a schematic flowchart of a control method for an electrical heating device according to an embodiment of the present invention.

In a preferred embodiment of the present invention, as shown in FIG. 3, the control method further includes: during turning on of the crankshaft heating belt 11 and when electrical heating is turned off, determining whether the air conditioner meets an electrical heating turning-on condition, and if the electrical heating turning-on condition is met, controlling to turn on electrical heating; and the electrical heating turning-on condition includes: the air conditioner is in the high-drop mode, the air conditioner is operating in a heating mode, and is powered on for the first time, and the crankshaft heating belt 11 is in a turned-on state; or the air conditioner is in the defrosting mode.

In the above-mentioned manner, during preheating of the compressor 1, whether the electrical heating turning-on condition is met is determined to turn on electrical heating, so that normal indoor heating can be met, and the user experience can be improved. When the compressor 1 is in a turned-off state, a communication signal from the outdoor unit to the indoor unit can be realized to ensure turning on of indoor electrical heating, which ensures the heating effect in a low temperature environment, and overcomes problems that: the heating effect of the compressor 1 is not obvious and the compressor 1 is easily damaged under low temperature conditions, and problems that: when the compressor 1 is not started, there is no signal from the outdoor unit to the indoor unit based on an original program, electrical heating cannot be turned on, and there is no heating indoors. Furthermore, after electrical heating is turned on, it is determined whether the air conditioner meets an electrical heating turning-off condition, and the electrical heating turning-off condition includes: the air conditioner does not meet any of the electrical heating turning-on conditions. When the air conditioner does not meet the electrical heating turning-on condition, electrical heating is turned off, which is beneficial for avoiding unnecessary energy consumption and saving energy.

In a preferred embodiment of the present invention, the electrical heating turning-on condition further includes: the air conditioner is in the high-drop mode and the heating mode, it is detected that the compressor 1 is in the started state, and when the outdoor ambient temperature T4 is lower than a third preset ambient temperature T43, the compressor 1 is turned off, and electrical heating is turned on; if the air conditioner is in the non-heating mode, electrical heating is controlled to be turned off or self-circulation determining of the heating mode is performed; if the compressor is not in the started state, electrical heating is turned off; and if the outdoor ambient temperature T4 does not meet a condition of being lower than the third preset ambient temperature T43, return to determining of whether the compressor 1 is started.

In the above-mentioned manner, in the high-drop mode and the heating mode, when the compressor 1 is detected to be turned on, if the outdoor ambient temperature T4 is less than the third preset ambient temperature T43, electrical heating is turned on, and the compressor 1 is turned off, which can prevent the lubricating oil from entering the pipeline with the refrigerant in the low temperature environment, thereby solving the problem of difficulty in oil return. At the same time, in the low temperature environment, if the refrigerant is mixed into the lubricating oil, turning on electrical heating and turning off the compressor 1 can avoid liquid hammer on the compressor 1, increasing the service life of the compressor 1 while meeting the heating demand.

In a preferred embodiment of the present invention, the control method further includes, after electrical heating is turned on, the outdoor ambient temperature T4 is greater than the first preset ambient temperature T41 (if the outdoor ambient temperature T4 is not greater than the first preset ambient temperature T41, return to the step of turning off the compressor and turning on electrical heating), and the following operations are performed based on whether the crankshaft heating belt 11 is turned on:

If the crankshaft heating belt 11 is turned on, the air conditioner is in the high-drop mode, and is powered on for the first time, the turning-on duration of the crankshaft heating belt 11 is not less than the second preset duration t2, and the outdoor ambient temperature T4 is continuously greater than the first preset ambient temperature T41 (if it is not met that the outdoor ambient temperature T4 is continuously greater than the first preset ambient temperature T41, self-circulation determining is performed that the outdoor ambient temperature T4 is continuously greater than the first preset ambient temperature T41), the compressor 1 is controlled to be started, and electrical heating is turned off.

Or, if the crankshaft heating belt 11 is not turned on, and the outdoor ambient temperature T4 is continuously greater than the first preset ambient temperature T41 (if it is not met that the outdoor ambient temperature T4 is continuously greater than the first preset ambient temperature T41, self-circulation determining is performed that the outdoor ambient temperature T4 is continuously greater than the first preset ambient temperature T41), the compressor 1 is controlled to be started, and electrical heating is turned off. In a preferred embodiment of the present invention, the first preset ambient temperature T41>the third preset ambient temperature T43.

In the above-mentioned manner, when the outdoor ambient temperature T4 is greater than the first preset ambient temperature T41, and the turning-on duration of the crankshaft heating belt 11 reaches the second preset duration t2, electrical heating is turned off, which can meet the heating demand and avoid unnecessary power consumption, which is beneficial to saving energy. The comparison between the outdoor ambient temperature T4 and the first preset ambient temperature T41 is added before the compressor 1 is started, which can prevent the compressor 1 from waiting for a long time before being started, resulting in great changes in the outdoor ambient temperature, so as to ensure stable and reliable starting of the compressor 1.

In a preferred embodiment of the present invention, selection of the high-drop mode may be set in an electrical control panel mode or in a dial.

It should be noted that, turning on or turning off electrical heating mentioned in the present embodiments means turning on or off the electrical heating device, and the outdoor electrical control panel controls the turning on or off of the electrical heating device by sending a W/D signal to the electrical heating device. When electrical heating is in the turned-on state, an outdoor W/D signal is enabled, or when electrical heating is in the turned-off state, an outdoor W/D signal is disabled, where W is an electrical auxiliary heating signal that comes with the air conditioning system, and D is an auxiliary heating signal of a gas furnace or another optional device. When the air conditioning system is controlled by a temperature controller, the temperature controller may also send a W/D signal to control turning on or off of the electrical heating device. The outdoor W/D signal is input to the indoor unit. When indoor electrical heating receives either one of the W/D signals from the temperature controller or the outdoor unit, electrical heating is turned on; and only when both signals do not exist, electrical heating is turned off.

The control method of the present invention, for a high drop or a long pipe, involves preheating of the compressor 1 by the crankshaft heating belt 11, control on operating of the compressor 1, and control on the electrical heating device 52. By setting respective different crankshaft heating belt turning-off conditions in different modes, it is possible to ensure that there is enough time to preheat the bottom of compressor 1, avoiding the problem of difficulty in oil return during heating. At the same time, in the cooling mode, the compressor 1 can be started directly and operate within an allowable operating range of refrigeration. Experiments have proved that there is no abnormality in the machine, so preheating is not required. After the specified compressor operating duration and compressor exhaust temperature T5 are met, preheating is turned off, which avoids unnecessary preheating and is beneficial for extending the service life of the crankshaft heating belt 11. During preheating of the compressor 1, whether to turn on electrical heating is determined, so that the room can be heated normally as required, and the compressor can operate normally within a specified ambient temperature range.

Corresponding to the control method suitable for an air conditioner in a high-drop mode in embodiments of the present invention, the present invention further provides a control device suitable for an air conditioner in a high-drop mode, which performs the control method suitable for an air conditioner in a high-drop mode as described above.

The above are merely preferred embodiments of the present invention, and are not used to limit the present invention. Any modifications, equivalent replacements, improvements, and the like made within the spirit and principle of the present invention shall be all included within the protection scope of the present invention.

As would be apparent to a person in the art, various working modifications may be made to the methods disclosed herein in order to implement the inventive concept as taught herein. Moreover, the actions of any flow diagram need not be implemented in the order shown; nor do all of the acts necessarily need to be performed. Also, those acts that are not dependent on other acts may be performed in parallel with the other acts.

The drawings and the forgoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, orders of processes described herein may be changed and are not limited to the manner described herein.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component of any or all the claims.

While specific language has been used to describe the subject matter, any limitations arising on account thereto, are not intended. As would be apparent to a person in the art, various working modifications may be made to the method in order to implement the inventive concept as taught herein. The drawings and the foregoing description give examples of embodiments. Those skilled in the art will appreciate that one or more of the described elements may well be combined into a single functional element. Alternatively, certain elements may be split into multiple functional elements. Elements from one or more embodiments may be added to any other embodiment.

We claim:

1. A control method suitable for an air conditioner in a high-drop mode, wherein the air conditioner comprises a controller, at least a compressor, and a crankshaft heating belt is provided at the bottom of the compressor, wherein the controller being programed to perform the control method comprising:

detecting an outdoor ambient temperature and a compressor exhaust temperature in real time by sensors;

determining whether the air conditioner meets a preheating condition;

if the air conditioner meets the preheating condition, turning on the crankshaft heating belt; and determining whether the air conditioner is in a high-drop mode;

if the air conditioner is in the high-drop mode, determining whether the air conditioner is in a cooling mode;

if the air conditioner is in the cooling mode, turning on the compressor, and determining whether to turn off the crankshaft heating belt based on an operating duration of the compressor and the compressor exhaust temperature.

2. The control method of claim 1, wherein responsive to the air conditioner being in a non-cooling mode and is powered on for a first time, prohibiting starting the compressor, and determining whether to turn off the crankshaft heating belt based on a turning-on duration of the crankshaft heating belt, the outdoor ambient temperature, and the compressor exhaust temperature.

3. The control method of claim 1, wherein responsive to the air conditioner being in a non-cooling mode and is not powered on for a first time, determining whether to turn off the crankshaft heating belt based on the outdoor ambient temperature and the compressor exhaust temperature.

4. The control method of claim 1, wherein during turning on of the crankshaft heating belt, determining whether the air conditioner meets a compressor turning-on condition, wherein the compressor turning-on condition comprises: in the high-drop mode, the air conditioner is in the cooling mode; or in the high-drop mode, the air conditioner is in the non-cooling mode, and the outdoor ambient temperature is higher than a first preset ambient temperature.

5. The control method according to claim 1, wherein the determining whether to turn off the crankshaft heating belt based on an operating duration of the compressor and the compressor exhaust temperature comprises:

when the operating duration of the compressor reaches a first preset duration and the compressor exhaust temperature is not less than a first preset exhaust temperature, controlling to turn off the crankshaft heating belt.

6. The control method according to claim 2, wherein the determining whether to turn off the crankshaft heating belt based on a turning-on duration of the crankshaft heating belt, the outdoor ambient temperature, and the compressor exhaust temperature comprises: when the turning-on duration of the crankshaft heating belt is not less than a second preset duration, the outdoor ambient temperature is greater than the first preset ambient temperature, and the compressor exhaust temperature is not less than the first preset exhaust temperature, controlling to turn off the crankshaft heating belt.

7. The control method according to claim 1, wherein the preheating condition comprises: the air conditioner is powered on for a first time, and until a startup signal is received, the compressor exhaust temperature is less than a second preset exhaust temperature for a third preset duration.

8. The control method according to claim 1, wherein the preheating condition comprises: the air conditioner is in a defrosting mode, and the compressor exhaust temperature is less than a third preset exhaust temperature.

9. The control method according to claim 1, wherein the preheating condition comprises: the compressor exhaust temperature is less than a fourth preset exhaust temperature or an exhaust temperature sensor is in a bad state; and the outdoor ambient temperature is lower than a second preset ambient temperature, and a shutdown duration of the compressor is greater than a fourth preset duration.

10. The control method according to claim 1, wherein the air conditioning system further comprises an indoor heat exchanger and an outdoor electrical control panel, an electrical heating device is provided at an outlet of the indoor heat exchanger, an electrical heating signal line is connected between the electrical heating device and the outdoor electrical control panel, the outdoor electrical control panel controls the electrical heating device to turn on or off through the electrical heating signal line.

11. The control method of claim 10 further comprises:

during turning on of the crankshaft heating belt and when electrical heating is turned off, determining whether the air conditioner meets an electrical heating turning-on condition, and if the electrical heating turning-on condition is met, controlling to turn on electrical heating; and the electrical heating turning-on condition comprises:

the air conditioner is in the high-drop mode, the air conditioner is operating in a heating mode, and is powered on for a first time, and the crankshaft heating belt is in a turned-on state; or the air conditioner is in a defrosting mode.

12. The control method of claim 11, wherein after electrical heating is turned on, the controller determines whether the air conditioner meets an electrical heating turning-off condition, and the electrical heating turning-off condition comprises: the air conditioner does not meet any of the electrical heating turning-on conditions.

13. The control method of claim 11, wherein the electrical heating turning-on condition further comprises: the air conditioner is in the high-drop mode and in the heating mode, the controller detects that the compressor is in a started state, and when the outdoor ambient temperature is lower than a third preset ambient temperature, the compressor is turned off, and electrical heating is turned on.

14. The control method of claim 11, wherein, further comprising, after electrical heating is turned on, when the outdoor ambient temperature is greater than the first preset ambient temperature, if the crankshaft heating belt is turned on, the turning-on duration of the crankshaft heating belt is not less than the second preset duration, and the outdoor ambient temperature is continuously greater than the first preset ambient temperature, controlling to start the compressor and turn off electrical heating.

15. The control method of claim 11, wherein, further comprising, after electrical heating is turned on, when the outdoor ambient temperature is greater than the first preset ambient temperature if the crankshaft heating belt is not turned on, and the outdoor ambient temperature is continuously greater than the first preset ambient temperature, controlling to start the compressor and turn off electrical heating.

16. A programed controller suitable for the air conditioner in a high-drop mode, which performs the control method suitable for an air conditioner in a high-drop mode according to claim 1.

* * * * *